US006208312B1

(12) United States Patent
Gould

(10) Patent No.: US 6,208,312 B1
(45) Date of Patent: Mar. 27, 2001

(54) MULTI-FEED MULTI-BAND ANTENNA

(76) Inventor: Harry J. Gould, 1649 E. Hale St., Mesa, AZ (US) 85203

( * ) Notice: Subject to any disclaimer, the term of this patent is extended or adjusted under 35 U.S.C. 154(b) by 0 days.

(21) Appl. No.: 09/525,799

(22) Filed: Mar. 15, 2000

(51) Int. Cl.[7] ..... H01Q 13/00; H01Q 19/12; H01Q 21/00

(52) U.S. Cl. ..... 343/840; 343/776; 343/779; 343/835

(58) Field of Search ..... 343/772, 775, 343/776, 779, 786, 835, 840; H01Q 21/00, 19/12, 13/00

(56) References Cited

U.S. PATENT DOCUMENTS 3,881,178 * 4/1975 Hannan ..... 343/779
4,353,073 * 10/1982 Brunner et al. ..... 343/779
4,638,322 * 1/1987 Lamberty ..... 343/761
5,245,353 9/1993 Gould ..... 343/786
5,283,591 * 2/1994 Delmas ..... 343/755
5,459,441 10/1995 Weber et al. ..... 343/786
5,859,620 * 1/1999 Skinner et al. ..... 343/880
6,031,507 * 2/2000 Aoki ..... 343/840

* cited by examiner

*Primary Examiner*—Don Wong
*Assistant Examiner*—Hoang Nguyen
(74) *Attorney, Agent, or Firm*—Parsons & Goltry; Robert A. Parsons; Michael W. Goltry

(57) ABSTRACT

A multi-feed, multi-band antenna includes a parabolic dish reflector, a plurality of four-port feeds, and may also include one or more orthomode two-port feeds. Each four-port feed is constructed to conduct multiple frequency bands and multiple polarized RF signals within each of the bands. A mounting structure mounts each of the feeds at a different position in a line and in a plane parallel to the rim of the reflector. The four-port feeds are of a size which allows them to be mounted adjacent each other and two degrees apart. The mounting structure positions the feeds at a distance F from the reflector. The diameter D of the reflector and the distance F have a relationship such that F/D is less than approximately 0.5.

27 Claims, 6 Drawing Sheets

MULTI-FEED MULTI-BAND ANTENNA

FIELD OF THE INVENTION

This invention relates to radio frequency antennas and more particularly, to radio frequency antennas capable of simultaneously transmitting and receiving a plurality of signals on a plurality of different radio frequency bands.

BACKGROUND OF THE INVENTION

At present, in an era of communications by satellite, stations which can communicate with multiple satellites and multiple frequency bands per satellite simultaneously are increasing in number. These stations include, for example, Cable TV stations and other television stations. Because each of these stations may communicate with dozens of satellites simultaneously, it is very inconvenient to incorporate antennas which are only capable of communicating with a single satellite. Therefore, it is highly advantageous for these stations to incorporate antennas which are capable of receiving and/or sending signals to multiple satellites simultaneously.

The main antenna being used today and capable of communicating with a plurality of satellites simultaneously is an antenna called "Simulsat" for Simultaneous Multiple Satellite Antenna Terminal. Simulsat has an elongated reflector which is constructed with a circular cross-section in the horizontal plane and with a parabolic cross-section in the vertical plane (generally referred to as quasi-parabolic). The size of the reflector for a small Simulsat antenna is 16 feet by 28 feet and the entire structure weighs 2000 pounds. Because of the size, the reflector is constructed in sections, typically three, which must be assembled at the sight.

It will be understood, by those skilled in the art that the communications satellites used in these applications are synchronous orbit satellites positioned generally in the equatorial plane. Thus, antennas incorporating a plurality of feeds for receiving signals from a plurality of satellites, position the feeds in a line spaced from an antenna reflector. The antenna must then be positioned so that each feed receives signals from a different satellite. Because of the elongated construction and the size, at different positions on the Earth's surface the Simulsat antenna must be rolled farther from the horizontal to compensate for the curvature of the Earth. To accomplish this positioning of the antenna, the structure must be mounted higher and higher above the ground so that the corner is sufficiently far from the ground.

As will be understood by those skilled in the art, the enormous size and weight of the Simulsat antenna causes many problems in mounting and directing it correctly. Also, the initial cost of the antenna is high and the mounting problems add substantially to the cost. Up to 35 feeds can be employed with this antenna. However, the cost will be the same for smaller stations that only want 10 or 12 feeds as for large stations that want up to 35 fees. Further if a station wants 36 or 37 feeds it must add a complete new antenna with all of the costs and mounting problems involved.

A second, less popular antenna is called the Taurus Antenna. This antenna is extremely large, heavy, and expensive. Also, it is designed, like the Simulsat antennas, for receiving only C-band signals from satellites.

When the Simulsat and Taurus antennas were originally designed, most of the communication satellites transmitted only C-band frequencies, commonly 3.7 GHz to 4.2 GHz. Kuband, commonly 11.7 GHz to 12.2 GHz, was added later in the 1980's to meet the demand for more bandwidth. Most of the current synchronous orbit satellites transmit both C-band and Ku-band signals. Also, during the 1990's the Federal Communications Commission (FCC) decreased the satellite spacing from four and one half degrees to two degrees to meet the demand for more bandwidth. This actually made the multiple feed application on a parabolic dish more desirable since the placement of second and third feeds two degrees away from the boresight feed will perform with only insignificant degradation. It should be noted that, throughout this disclosure, a reference to antenna feed positions or locations two degrees (or two degrees off boresight), four degrees, six degrees, etc. is a reference to the spacing of the satellites from which the feeds are receiving signals. Thus, a first feed positioned at the boresight will receive signals from a first satellite and a second feed spaced "two degrees" from the first feed will receive signals from a second satellite spaced two degrees from the first satellite, etc.

To date, no single prior art satellite communications parabolic reflector antenna in the 12 to 16 foot range has been able to incorporate multiple antenna feeds positioned adjacent each other which can receive both C-band and Ku-band signals from three or more satellites spaced two degrees apart. Previously, as will be explained in more detail presently, some C-band feeds have been constructed which can be positioned two degrees apart. However, these antenna feeds receive C-band only and cannot be modified to simultaneously receive Ku-band signals. The Simulsat and Taurus antennas perform acceptably well at C-band, however, due to a circular curvature or cross-section, rather than parabolic, in the horizontal plane, they usually have unacceptable performance at Ku-band frequencies. Since the wavelength at Ku-band is approximately ⅓ the length at C-band, the circular curvature creates three times the phase error at Ku-band as it does at C-band.

While the background discussion has been focused primarily on C-band and Ku-band antennas, because of their popularity at the present time, it will be understood that other frequency band antennas may become popular in the future. In fact, at the present time some signals in higher frequency bands are being considered. For example, 18 GHz signals (in the upper Ku-band or sometimes considered to be in the K-band) and 30 GHz signals (in the Ka-band) are presently experiencing some limited use. It is of course intended that all such frequencies and bands be included in the present invention.

Accordingly it is highly desirable to provide an antenna assembly which solves the above described problems.

It is an object of the present invention to provide a new and improved multi-feed, multi-band antenna.

It is another object of the present invention to provide a new and improved multi-feed, multi-band antenna including multiple feeds each capable of C-band and Ku-band reception, and capable of being positioned two degrees apart.

It is another object of the present invention to provide a new and improved multi-feed, multi-band antenna which is small, light, and which is inexpensive and easy to use.

It is still another object of the present invention to provide a new and improved multi-feed, multi-band antenna which can be easily and inexpensively mounted.

It is a further object of the present invention to provide a new and improved multi-feed, multi-band antenna which is sufficiently inexpensive and small to allow the installation of multiple antennas, if needed, without unduly imposing mounting area and cost restrictions and problems.

BRIEF DESCRIPTION OF THE DRAWINGS

Referring to the drawings.

DESCRIPTION OF THE PREFERRED EMBODIMENTS

Figure 1:
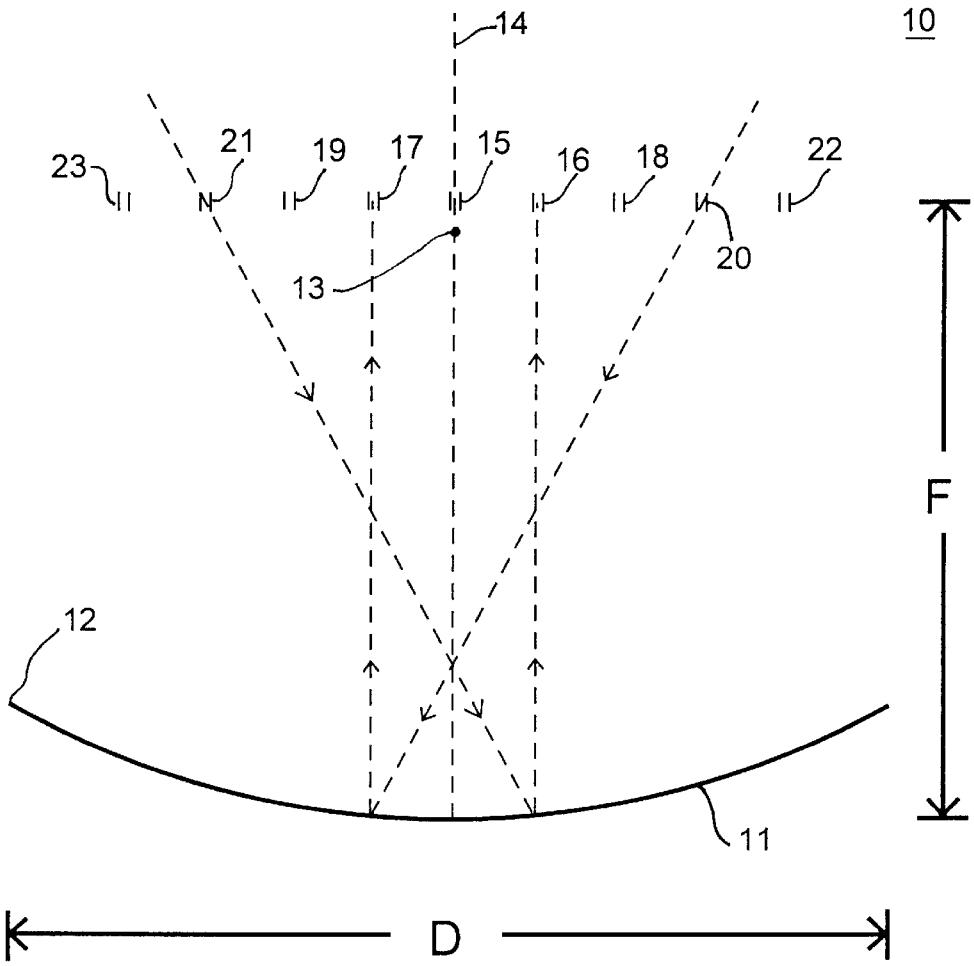
FIG. 1 is a schematic view illustrating an antenna assembly in accordance with the present invention, showing positions of various feeds relative to a parabolic dish reflector.

Turning now to the drawings and specifically to FIG. 1, a schematic view is illustrated of an antenna assembly 10 in accordance with the present invention, showing positions of a plurality of feeds relative to a parabolic dish reflector 11. In this schematic view parabolic dish reflector 11 is illustrated in cross-section for convenience but it should be understood that the reflecting surface of parabolic dish reflector 11 is a parabola having a continuous edge 12. Edge 12 of parabolic dish reflector 11 lies in a plane and has a diameter D. Further, parabolic dish reflector 11 has a boresight 14 which is a major axis of the parabola. A focal point 13 of parabolic dish reflector 11 lies along boresight 14.

A plurality of radio frequency (RF) feeds are illustrated schematically as apertures 15 through 23 of the feeds, for convenience in this explanation. Aperture 15 is located along boresight 14 approximately at focal point 13 to receive signals from a first satellite. The distance from aperture 15 to the surface of parabolic dish reflector 11 is designated F. Apertures 16 and 17 are located two degrees off boresight 14 and on opposite sides of boresight 14 (i.e. they receive signals from second and third satellites two degrees on either side of the first satellite). Apertures 18 and 19 are located four degrees off boresight 14 and on opposite sides of boresight 14 (i.e. they receive signals from fourth and fifth satellites four degrees on either side of the first satellite). Apertures 20 and 21 are located six degrees off boresight 14 and on opposite sides of boresight 14 (i.e. they receive signals from sixth and seventh satellites six degrees on either side of the first satellite). Apertures 20 and 21 are located eight degrees off boresight 14 and on opposite sides of boresight 14 (i.e. they receive signals from eighth and ninth satellite eight degrees on either side of the first satellite).

Here it should be specifically noted that a feed aperture positioned near the focal point along the boresight can be adjusted for the best signal reception, as will be explained presently. Feeds moved to a point two degrees off the boresight, represented by apertures 16 and 17, experience a slight degradation of the signal but it is generally so slight as to be insignificant. Feeds moved to four degrees off the boresight, represented by apertures 18 and 19, begin to experience noticeable degradation, but are still usable for most applications, and feeds positioned at six or eight degrees off the boresight, represented by apertures 20 through 23, experience significant degradation but these feeds may still be usable as backup feeds during maintenance periods or the like.

Figure 2:
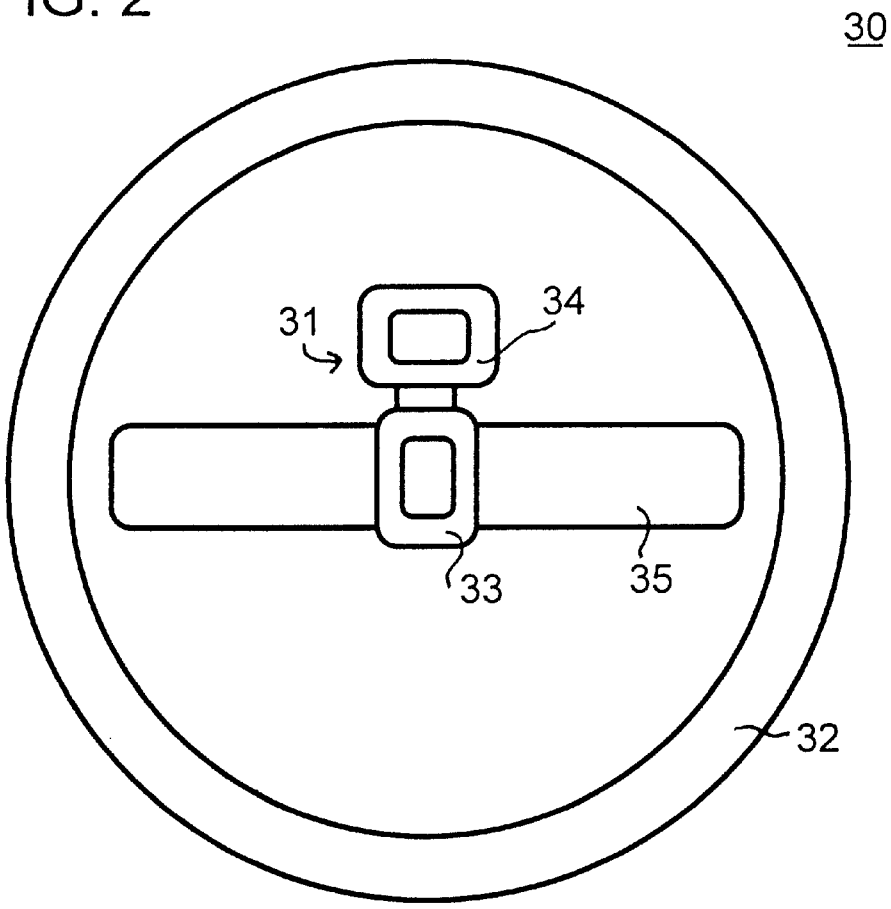
FIG. 2 is a simplified rear plan view of an antenna assembly incorporating a prior art orthomode-waveguide (dual-waveguide) feed aligned along the boresight of the antenna.

Turning now to FIG. 2, a simplified rear plan view of an antenna assembly 30 incorporating a prior art multi-waveguide (two-port) feed 31 (hereinafter referred to as an orthomode-waveguide feed) aligned along the boresight of the antenna is illustrated. A circular mounting structure 32 is shown which is adapted to be mounted in spaced relationship from a parabolic dish reflector (not shown). Orthomode-waveguide feed 31 includes a first waveguide 33 and a second waveguide 34 attached to receive two orthogonally polarized RF signals through a common aperture (not shown). Orthomode-waveguide feed 31 is capable of receiving the two orthogonally polarized signals from a satellite which illuminates the parabolic dish reflector and which is focused by the parabolic dish reflector into the receiving aperture. Each of the orthogonally polarized signals is then carried to a separate receiver via orthogonal waveguides 33 and 34, respectively.

Waveguides 33 and 34 are mounted so that the common receiving aperture extends through a slot 35 to receive RF energy from the illuminated parabolic dish reflector. Waveguides 33 and 34 are oriented with their major axes orthogonal to receive the orthogonally polarized RF signals, in a single band of frequencies (generally the C-band in this example), and are positioned along the boresight of the parabolic dish reflector with the common aperture at or near the focal point. As will be understood, orthomode-waveguide feed 31 can be moved to positions two degrees or four degrees off boresight, if desired. Mounting structure 32 is constructed to arrange the orthomode-waveguide feeds in a line perpendicular to the boresight of the antenna and spaced from the reflector approximately at the focal length so that each individual feed can be directed to receive signals from an individual satellite. With some manipulation, it is possible for more than one orthomode-waveguide feed 31 to be mounted on circular mounting structure 32, if desired. However, it should be specifically noted that antenna assembly 30 can only receive orthogonally polarized C-band signals from a single satellite for each single orthomode-waveguide feed 31 incorporated.

Figure 3:
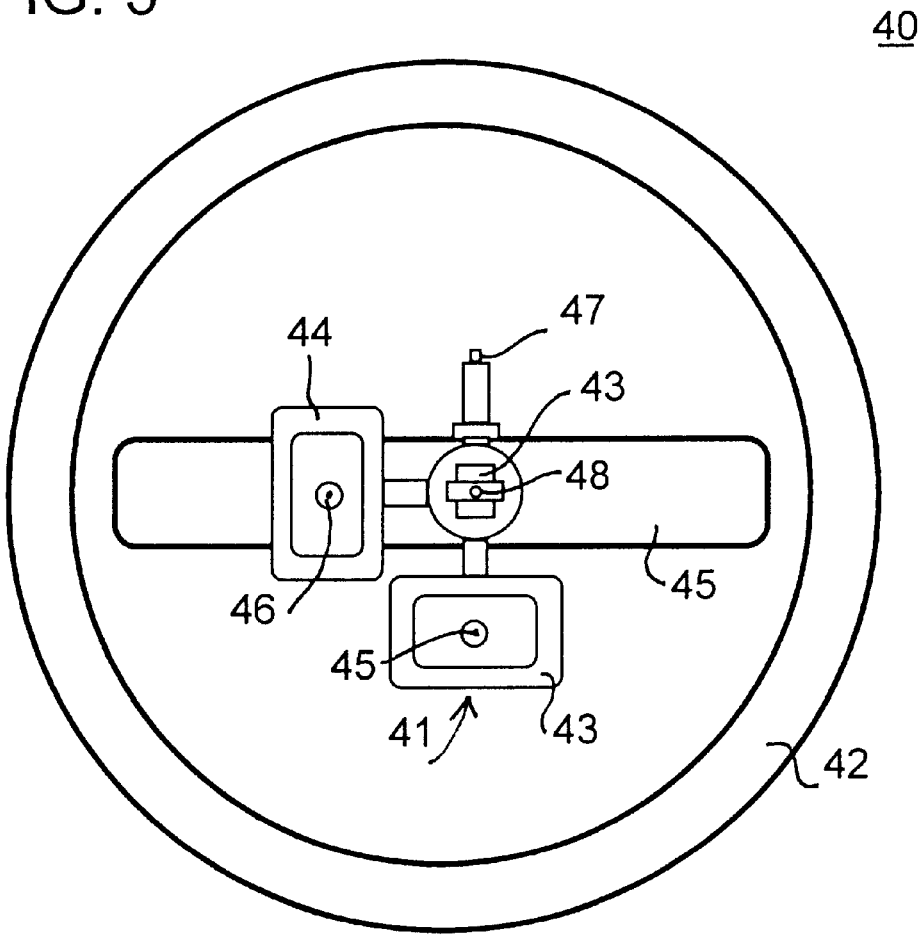
FIG. 3 is a simplified rear plan view of an antenna assembly, similar to FIG. 2, with a prior art four-port waveguide feed aligned along the boresight of the antenna.

Turning now to FIG. 3, a simplified rear plan view of an antenna assembly 40 is illustrated. Assembly 40 includes a prior art four-port waveguide feed 41 aligned along the boresight of the antenna. A circular mounting structure 42 is shown which is adapted to be mounted in spaced relationship from a parabolic dish reflector (not shown). Four-port waveguide feed 41 includes a first waveguide 43 and a second waveguide 44 attached to receive two orthogonally polarized RF signals in the C-band through a common aperture (not shown). The C-band signals are carried to C-band receivers by coaxial cables 45 and 46, respectively. A second pair of orthogonal Ku-band signals are received through the common aperture by an LNB (Low Noise Block down-converter) network 43, down-converted, and carried to Ku-band receivers by coaxial cables 47 and 48, respectively. Thus, four-port waveguide feed 41 is capable of receiving two C-band signals and two Ku-band signals simultaneously.

Figure 4:
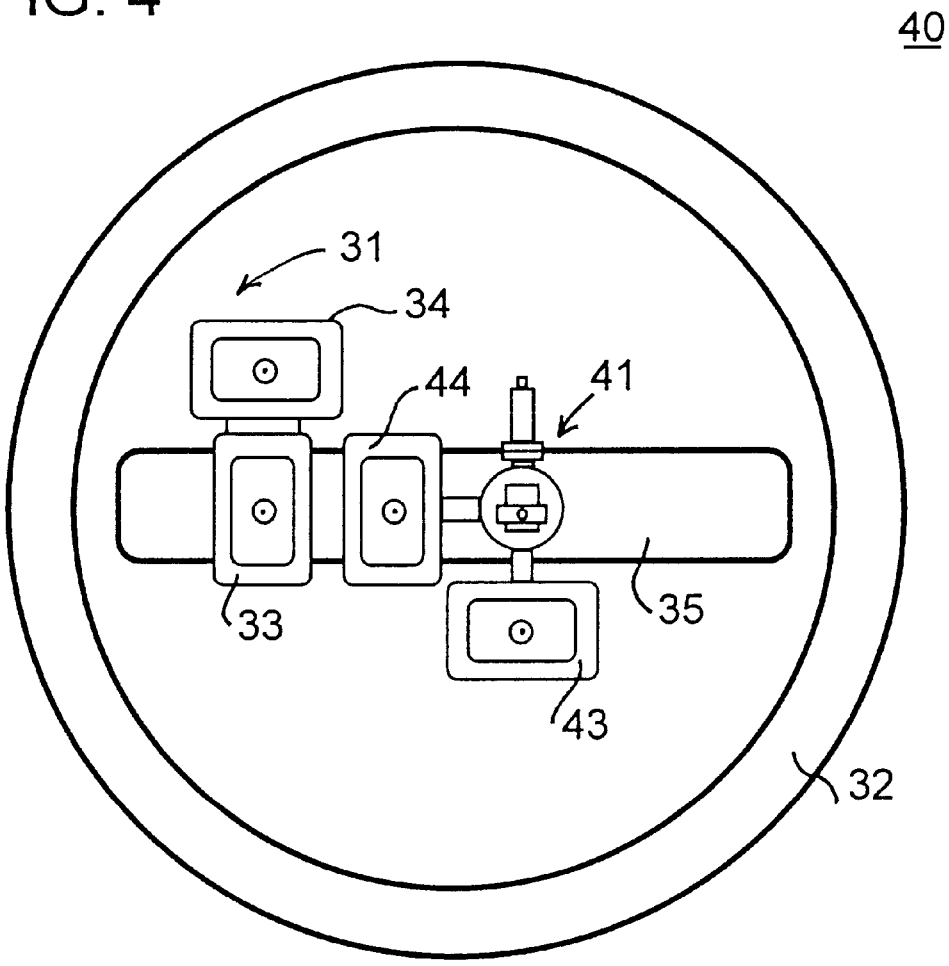
FIG. 4 is a simplified rear plan view of the antenna assembly of FIG. 3, including the prior art four-port waveguide feed and the orthomode-waveguide feed of FIG. 2 positioned adjacent thereto.

Referring additionally to FIG. 4, a simplified rear plan view of antenna assembly 40 of FIG. 3, including four-port waveguide feed 41, with orthomode-waveguide feed 31 of FIG. 2 positioned adjacent thereto. As can be seen from this view, feed 31 is positioned as close as it can be (on the left) to feed 41 but there is still more than four degrees of separation. If feed 31 is positioned adjacent feed 41 on the right side, there still could be slightly greater than two degrees of separation between them. Thus, it is clear from this view that a plurality of either feeds 31 and or feeds 41 cannot be positioned in a line and two degrees apart. Specifically, a four-port feed 41 cannot be mounted with either a four-port feed 41 or a two-port feed 31 on each side and two degrees apart.

Figure 5:
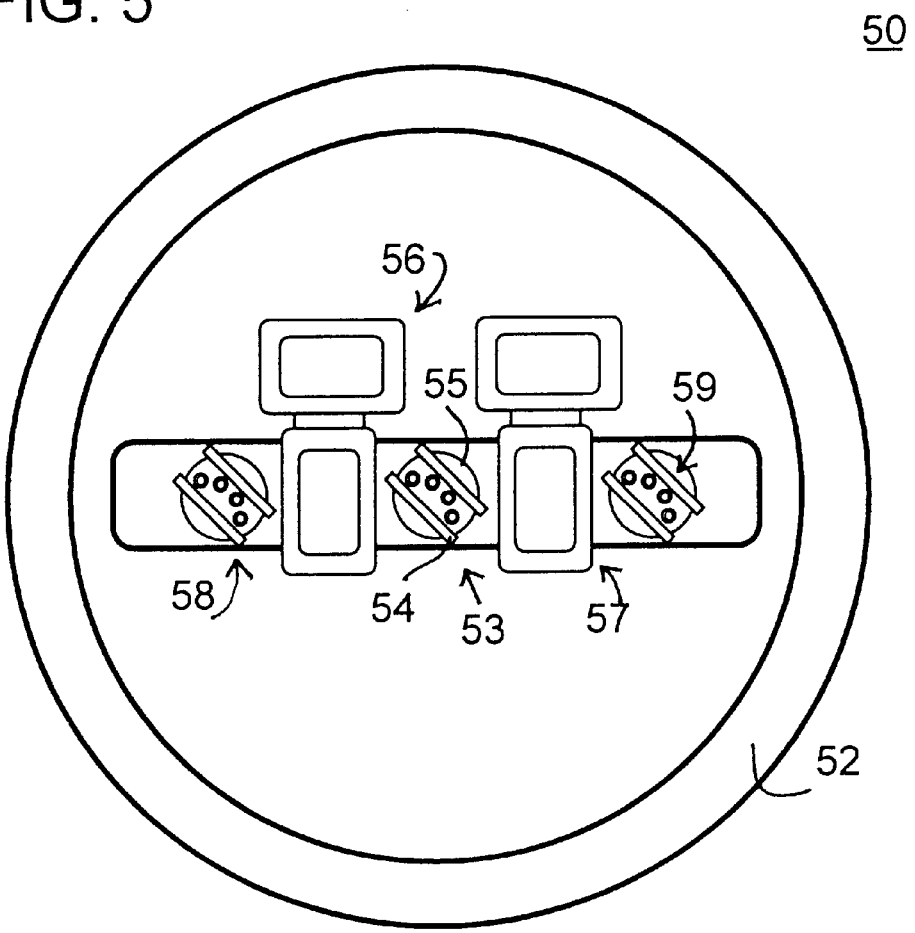
FIG. 5 is a simplified rear plan view of an antenna assembly incorporating a combination of four-port feeds, positioned at the boresight and four degrees off the boresight of the antenna and orthomode-waveguide feeds positioned two degrees off the boresight on either side of the boresight of the antenna in accordance with the present invention.

Turning now to FIG. 5, a simplified rear plan view of an antenna assembly 50, in accordance with the present invention, is illustrated. A circular mounting structure 52 is shown which is adapted to be mounted in spaced relationship from a parabolic dish reflector (not shown) and along the boresight of the parabolic dish reflector. In this embodiment, mounting structure 52 is approximately the same size as mounting structure 32 (see FIG. 2) and has a plurality of waveguide feeds or devices associated therewith. Mounting structure 52 is constructed to arrange the plurality of waveguide feeds adjacent each other and in a line perpendicular to the boresight of the antenna and spaced from the reflector approximately at the focal length so that each individual feed can be directed to receive signals from am individual satellite. A first waveguide feed, designated 53, includes coaxially positioned waveguides designed to receive energy in two different frequency bands (e.g. the C-band and the Ku-band) Further, each of the coaxial waveguides has a pair of orthogonally oriented probes therein for receiving orthogonally polarized radio frequency signals. As explained in more detail in U.S. Pat. No. 5,245,353, issued. Sep. 14, 1993, entitled "Dual-Waveguide Probes Extending Through Back Wall", and incorporated herein by reference, the dual probes enter the coaxial cavities from the rear to greatly reduce the size of the structure. Because of this feature, the electronics (designated 54) can be mounted generally coaxially at the rear end of the coaxial cavities (designated 55), so that the transverse extent of the structure is minimized.

Waveguide feed 53 is capable of simultaneously receiving multiple frequency bands and multiple polarized radio frequency signals within each of the multiple frequency bands. In the preferred embodiment, waveguide feed 53 is capable of receiving two orthogonally polarized signals in the C-band and two orthogonally polarized signals in the Ku-band from a single satellite. Since waveguide feed 53, in this embodiment, is designed to simultaneously receive four signals, it and any other waveguide feed designed to simultaneously receive four signals is referred to hereinafter as a "four-port" feed or device. A further description of a four-port feed and the operation thereof can be found in a copending U.S. Patent Application entitled "Coaxial Waveguide Feed With Reduced Outer Diameter", U.S. Ser. No. 09/234,875, filed on Jan. 21, 1999, and incorporated herein by reference.

Referring again to FIG. 5, four-port feed 53 is mounted on the boresight of antenna assembly 50 with an aperture (see FIG. 1) approximately at the focal point of the parabolic dish reflector. In the preferred embodiment, the parabolic dish reflector is constructed with a diameter of approximately twelve foot to sixteen foot and the ratio F/D is below approximately 0.5 and preferably in a range of 0.3 to 0.45. Here it should be noted that a feed aperture designed to pick up all of the energy reflected by the parabolic dish reflector may pick up energy from beyond the edges of the parabolic dish reflector, i.e. the background. This additional energy is received as noise and can be as high as 290° K. if the background is Earth and as low as 25° K. if the background is the sky. In the preferred embodiment, the aperture of fourport feed 53 is adjusted to maximize the signal-to-noise ratio of antenna assembly 50. Further, because of the small transverse size of four-port feed 53, a smaller amount of area is required within mounting structure 52. Also, antenna assembly 50 is relatively small overall and because it uses a parabolic dish reflector, it is light and easy to mount.

By designing and constructing four-port feed 53 relatively small, one or more waveguide feeds, similar to four-port feed 53, can be incorporated into the plurality of waveguide feeds or devices associated with mounting structure 52. As can be seen in FIG. 5, four-port feed 53 positioned on the boresight of antenna 50 is small enough to allow Orthomode-waveguide feeds 56 and 57 to be positioned two degrees off the boresight on each side of four-port feed 53. Further, four-port feeds 58 and 59, similar to feed 53, are positioned at four degrees off the boresight and on either side of the boresight. Additionally, two four-port feeds (not shown), similar to feed 53, can be positioned at six degrees off the boresight and on either side of the boresight, if desired. In some instances, older satellites only transmit on the C-band so that it may be convenient to include one or more orthomode-waveguide feeds in combination with one or more four-port feeds, as illustrated in antenna 50 of FIG. 5. While an alternating order of four-port feeds and orthomode-waveguide feeds is illustrated in FIG. 5, it will be understood that the four-port feeds and the orthomode-waveguide feeds can be positioned in any desired order.

Here it is important to again note that waveguide feeds positioned on the boresight and at two degrees off the boresight on opposite sides, are the primary feeds which receive signals with no significant degradation. Waveguide feeds at four degrees off the boresight on either side are slightly degraded but are very usable. If waveguide feeds cannot be positioned on the boresight and at two degrees off the boresight in an antenna and/or if only orthomode-waveguide feeds can be incorporated, the antenna is not used to its full capability, which increases the cost and mounting space required. In addition, if waveguide feeds can be placed at six degrees off boresight, while the reception of these feeds is degraded significantly, the waveguide feeds can be used as backups, etc. and add substantially to the value of antenna 50.

Figure 6:
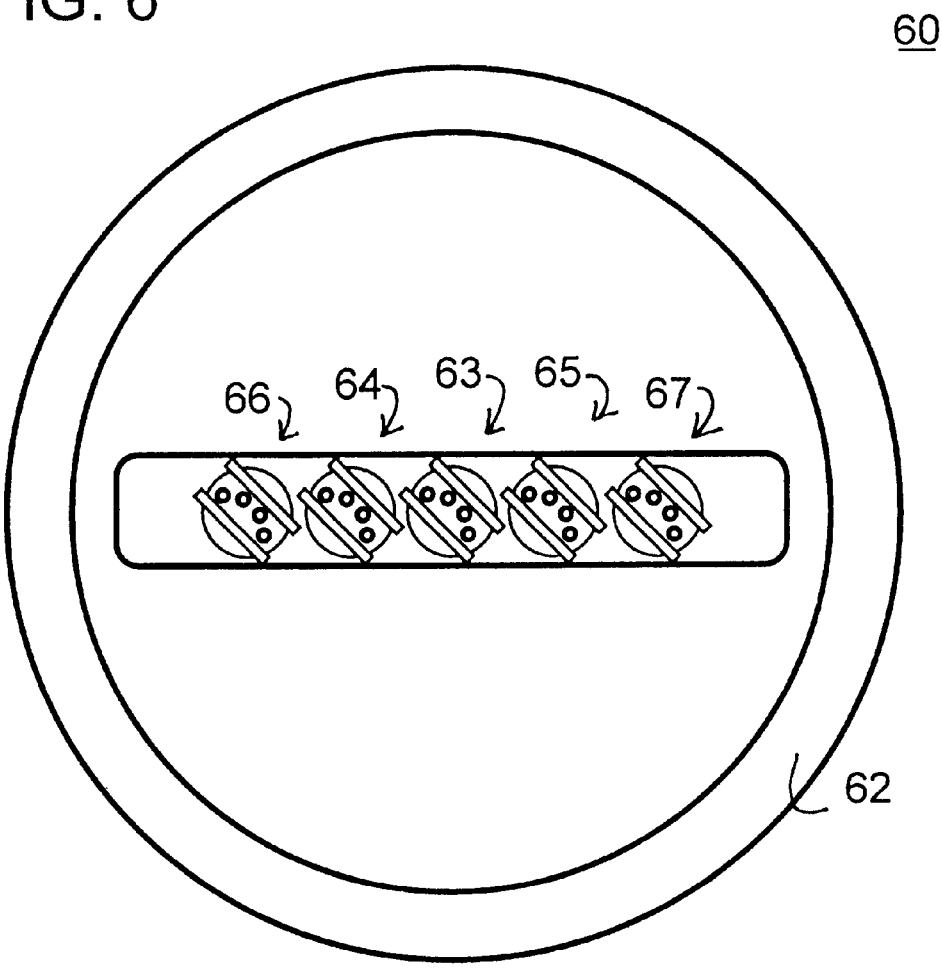
FIG. 6 is a simplified rear plan view of an antenna feed assembly incorporating four-port feeds positioned at the boresight, two degrees off the boresight and on opposite sides of the boresight, and four degrees off the boresight and on opposite sides of the boresight of the antenna in accordance with the present invention.

Turning now to FIG. 6, a rear plan view of an antenna assembly 60, in accordance with the present invention, is illustrated. A circular mounting structure 62 is shown which is adapted to be mounted in spaced relationship from a parabolic dish reflector (not shown) and along the boresight of the parabolic dish reflector. Mounting structure 62 is approximately the same size as mounting structure 32 (see FIG. 2) and has a plurality of four-port feeds or devices associated therewith.

A first four-port feed, designated 63, is similar to four-port feed 53 described above. Four-port feed 63 is positioned on the boresight of antenna 60 with its aperture approximately at the focal point of the parabolic dish reflector. Antenna assembly 60 is designed with the ratio F/D less than approximately 0.5 and preferably in a range of 0.3 to 0.45. Also, four-port feed 63 is constructed relatively small in the transverse direction, generally as previously described.

Because of the size of four-port feed 63, second and third four-port feeds 64 and 65 can be conveniently positioned at two degrees off the boresight on either side of four-port feed 63. Also, because of the size of four-port feeds 63, 64, and 65, fourth and fifth four-port feeds 66 and 67 can be conveniently positioned at four degrees off the boresight adjacent four-port feeds 64 and 65, respectively. Further, if desired, two additional four-port feeds (not shown) can be placed adjacent four-port feeds 66 and 67, respectively, at six degrees off the boresight.

Thus, a new and improved multi-feed, multi-band antenna is illustrated and described which includes a parabolic dish reflector having a boresight, a plurality of four-port feeds or devices, each feed being constructed to conduct multiple frequency bands and multiple polarized radio frequency signals within each of the multiple frequency bands, and a mounting structure constructed to position each of the plurality of feeds at different positions relative to the parabolic dish reflector including one of the boresight and a position adjacent the boresight, e.g. two degrees off the boresight, four degrees off the boresight, six degrees off the boresight, eight degrees off the boresight, etc. While each of the above described antenna assemblies has a feed positioned along the boresight for convenience in the description and understanding, it should be understood that all of the feeds could be situated slightly off of the boresight, if desired. For example, instead of being situated along the boresight and at two degrees on either side, feeds could be situated at one degree on either side of the boresight and at three degrees on either side of the boresight. Many other configurations will be readily apparent to those skilled in the art upon reading this disclosure and all such configurations are intended to be covered by the claims.

Thus, a satellite communications antenna is disclosed which is able to incorporate multiple antenna feeds positioned adjacent each other which can receive orthogonally polarized signals in both C-band and Ku-band from three or more satellites spaced two degrees, four degrees, six degrees, or more apart. The new and improved multi-feed, multi-band antenna is small, light, inexpensive and easy to mount and use. Further, if additional feeds are required, one or more additional antennas can be used, with the total cost and required mounting area still being less than the total cost and required mounting area of the prior art.

While I have shown and described specific embodiments of the present invention, further modifications and improvements will occur to those skilled in the art. I desire it to be understood, therefore, that this invention is not limited to the particular forms shown and I intend in the appended claims to cover all modifications that do not depart from the spirit and scope of this invention.

What is claimed is:

1. A multi-feed, multi-band antenna comprising:

a parabolic dish reflector having a boresight;

a plurality of antenna feeds, at least one of the plurality of antenna feeds being a four-port feed; and a mounting structure mounting the plurality of antenna feeds adjacent the parabolic dish and constructed to position the plurality of antenna feeds relative to the parabolic dish reflector at different positions in a line and two degrees apart, the different positions including one of the boresight and positions adjacent the boresight, and the mounting structure being constructed to mount the four-port feed at one of the different positions with two of the plurality of antenna feeds mounted adjacent to and on opposite sides of the four-port feed and two degrees from the four-port feed.

2. A multi-feed, multi-band antenna as claimed in claim 1 wherein the parabolic dish reflector has a diameter D and the mounting structure positions each of the plurality of devices at a distance F from the parabolic dish reflector, the diameter D and the distance F having a relationship such that F/D is less than approximately 0.5.

3. A multi-feed, multi-band antenna as claimed in claim 2 wherein the relationship F/D is in a range of approximately 0.3 to 0.45.

4. A multi-feed, multi-band antenna as claimed in claim 1 wherein the parabolic dish reflector has a diameter D of approximately 12 feet to 16 feet.

5. A multi-feed, multi-band antenna as claimed in claim 1 wherein the positions adjacent the boresight include positions two degrees from the boresight and four degrees from the boresight.

6. A multi-feed, multi-band antenna as claimed in claim 1 wherein the positions adjacent the boresight include positions one degree from the boresight and three degrees from the boresight.

7. A multi-feed, multi-band antenna as claimed in claim 1 wherein the mounting structure defines a plurality of positions lying approximately in a plane parallel to a rim of the parabolic dish reflector, the plurality of positions including a position at the boresight, positions two degrees from the boresight and on opposite sides of the boresight, and positions four degrees from the boresight and on opposite sides of the boresight.

8. A multi-feed, multi-band antenna as claimed in claim 1 wherein the four-port feed is constructed to conduct multiple frequency bands including C-band and Ku-band.

9. A multi-feed, multi-band antenna as claimed in claim 8 wherein the four-port feed is constructed to conduct two orthogonally polarized radio frequency signals within each of the C-band and Ku-band.

10. A multi-feed, multi-band antenna as claimed in claim 1 wherein at least three of the plurality of waveguide feeds are four-port feeds.

11. A multi-feed, multi-band antenna as claimed in claim 10 including at least one orthomode-waveguide feed positioned adjacent one of the four-port feeds.

12. A multi-feed, multi-band antenna as claimed in claim 1 wherein at least three of the plurality of waveguide feeds are four-port feeds positioned two degrees apart.

13. A multi-feed, multi-band antenna as claimed in claim 1 wherein the at least one of the plurality of waveguide feeds includes a four-port feed having an aperture with a size designed to maximize a signal-to-noise ratio in the antenna.

14. A multi-feed, multi-band antenna comprising:

a parabolic dish reflector having a boresight and a diameter D;

a plurality of four-port feeds, each feed being constructed to conduct multiple frequency bands and multiple polarized radio frequency signals within each of the multiple frequency bands; and a mounting structure mounting the plurality of four-port feeds adjacent the parabolic dish and constructed to position each of the plurality of feeds at different positions in a line two degrees apart relative to the parabolic dish reflector and at approximately a distance F from the parabolic dish reflector, the diameter D and the distance F having a relationship such that F/D is less than approximately 0.5.

15. A multi-feed, multi-band antenna as claimed in claim 14 wherein the relationship F/D is in a range of approximately 0.3 to 0.45.

16. A multi-feed, multi-band antenna as claimed in claim 14 wherein the parabolic dish reflector has a diameter D of approximately 12 feet to 16 feet.

17. A multi-feed, multi-band antenna as claimed in claim 14 wherein the mounting structure defines a plurality of positions lying approximately in a plane parallel to a rim of the parabolic dish reflector, the plurality of positions including a position at the boresight, positions two degrees from the boresight and on opposite sides of the boresight, and positions four degrees from the boresight and on opposite sides of the boresight.

18. A multi-feed, multi-band antenna as claimed in claim 14 wherein the each of the feeds is constructed to conduct multiple frequency bands including C-band and Ku-band.

19. A multi-feed, multi-band antenna as claimed in claim 18 wherein each of the feeds is constructed to conduct two orthogonally polarized radio frequency signals within each of the C-band and Ku-band.

20. A multi-feed, multi-band antenna as claimed in claim 14 including at least one orthomode-feed positioned adjacent one of the four-port feeds and two degrees apart.

21. A multi-feed, multi-band antenna as claimed in claim 14 wherein each of the plurality of four-port feeds has an aperture with a size designed to maximize a signal-to-noise ratio in the antenna.

22. A multi-feed, multi-band antenna comprising:

a parabolic dish reflector having a boresight and a diameter D at a rim of the parabolic dish reflector;

a plurality of four-port feeds, each feed being constructed to conduct multiple frequency bands and multiple polarized radio frequency signals within each of the multiple frequency bands, and each of the plurality of four-port feeds having an aperture with a size designed to maximize a signal-to-noise ratio in the antenna; and a mounting structure mounting the plurality of four-port feeds adjacent the parabolic dish and constructed to define a plurality of positions lying approximately in a plane parallel to the rim of the parabolic dish reflector, the plurality of positions including positions in a line and two degrees apart, the mounting structure mounting each of the plurality of feeds at different positions of the plurality of positions relative to the parabolic dish reflector and at approximately a distance F from the parabolic dish reflector, the diameter D and the distance F having a relationship such that F/D is less than approximately 0.5.

23. A multi-feed, multi-band antenna as claimed in claim 22 wherein the relationship F/D is in a range of approximately 0.3 to 0.45.

24. A multi-feed, multi-band antenna as claimed in claim 22 wherein the parabolic dish reflector has a diameter D of approximately 12 feet to 16 feet.

25. A multi-feed, multi-band antenna as claimed in claim 22 wherein the each of the feeds is constructed to conduct multiple frequency bands including C-band and Ku-band.

26. A multi-feed, multi-band antenna as claimed in claim 25 wherein each of the feeds is constructed to conduct two orthogonally polarized radio frequency signals within each of the C-band and Ku-band.

27. A multi-feed, multi-band antenna as claimed in claim 22 including at least one orthomode-waveguide feed positioned adjacent one of the plurality of four-port feeds.

* * * * *